US009066566B2

(12) United States Patent
Lai

(10) Patent No.: US 9,066,566 B2
(45) Date of Patent: Jun. 30, 2015

(54) TRANSPARENT SHELL STRUCTURE FOR LUGGAGE AND THE LIKE

(71) Applicants: Chia-Hung Lai, Taichung (TW); Meng-Chun Lai Chu, Taichung (TW); Chen Yueh Hsu, Taoyuan, Taoyuan County (TW)

(72) Inventor: Chia-Hung Lai, Taichung (TW)

(73) Assignees: Chia-Hung Lai, Taichung (TW); Meng-Chun Lai Chu, Taichung (TW); Chen Yuch Hsu, Taoyuan, Taoyuan County (TW)

( * ) Notice: Subject to any disclaimer, the term of this patent is extended or adjusted under 35 U.S.C. 154(b) by 74 days.

(21) Appl. No.: 13/742,106

(22) Filed: Jan. 15, 2013

(65) Prior Publication Data

US 2014/0008164 A1 Jan. 9, 2014

(30) Foreign Application Priority Data

Jul. 3, 2012 (CN) ..... 2012 2 0316574 U

(51) Int. Cl.

*A45C 13/08* (2006.01)
*A45C 13/00* (2006.01)
*A45C 13/36* (2006.01)

(52) U.S. Cl.

CPC ..... *A45C 13/001* (2013.01); *A45C 13/08* (2013.01); *A45C 13/36* (2013.01); *A45C 2200/10* (2013.01)

(58) Field of Classification Search

CPC .. A45C 13/002; A45C 2200/10; A45C 13/04; A45C 13/08; A45C 13/36; A45C 2005/037

USPC ..... 190/122, 125, 123, 126, 127, 24; 150/128; 383/106, 107, 109, 111

See application file for complete search history.

(56) References Cited

U.S. PATENT DOCUMENTS

| | | | | |
|---|---|---|---|---|
| 384,969 | A * | 6/1888 | Frankel | 190/126 |
| 1,297,994 | A * | 3/1919 | Boyer | 229/400 |
| 2,716,473 | A * | 8/1955 | Droutman | 190/119 |
| 2,832,448 | A * | 4/1958 | Axtell | 190/122 |
| 3,477,553 | A * | 11/1969 | Kish, Jr. | 190/119 |
| 5,009,319 | A * | 4/1991 | Jantzen | 206/544 |
| 6,210,037 | B1 * | 4/2001 | Brandon, Jr. | 383/111 |
| 6,755,288 | B1 * | 6/2004 | Lai | 190/24 |
| 8,028,730 | B2 * | 10/2011 | Whiting et al. | 150/104 |
| 2006/0201764 | A1 * | 9/2006 | Morszeck | 190/125 |

FOREIGN PATENT DOCUMENTS

WO WO 2011/127784 A1 * 10/2011

* cited by examiner

*Primary Examiner* — Sue A Weaver

(74) *Attorney, Agent, or Firm* — Muncy, Geissler, Olds & Lowe, P.C.

(57) ABSTRACT

A transparent shell structure for luggage and the like includes an outer shell, a decorative plate, a lining, and a plurality of corner protectors. The outer shell has an inner space with a frame. One side of the decorative plate is a patterned surface. Each of the four corners of the decorative plate has a notch, so that the four sides thereof are bent inside the inner space. The decorative plate is restricted within the outer shell. The lining is attached to the decorative plate and disposed in the inner space of the outer shell with the decorative plate, connecting to the frame by the sides. The corner protectors are connected to the four corners of the outer shell.

8 Claims, 16 Drawing Sheets

TRANSPARENT SHELL STRUCTURE FOR LUGGAGE AND THE LIKE

BACKGROUND OF THE INVENTION

1. Field of Invention

The invention relates to a shell structure for luggage and the like and, in particular, to an improved transparent shell structure.

2. Related Art

As shown in FIGS. 15 and 16, the conventional luggage shell structure has an inner shell 91 inside a transparent outer shell 90, including one lining 92 inside the inner shell 91. The inner shell 91 is cured and molded through thermoplastic process and vacuum suction. The inner shell 91 has a three-dimensional profile and includes a flat decorative surface 910. During the thermoplastic process, the side surface of the inner shell is formed with a curved surface 911. The decorative surface 910 is printed with a pattern 912. When the inner shell 91 is disposed inside the outer shell 90, the outer shell 90 has a sparkling visual effect because of the transparency thereof. The outer shell 90 may be seen through. Therefore, when one watches the pattern 912 printed on the decorative surface 910, it produces a sense of layers to attract consumers to buy. However, this conventional luggage shell structure has the following problems.

1. Through the thermoplastic molding and vacuum suction, the inner shell 91 is cured to form the flat decorative surface 910 and curved surface 911 on the side. While the curved surface 911 is formed inside the inner shell 91, part of the curved surface 911 is extended and stretched so that the thickness reduces and the surface color becomes lighter. If the pattern 912 is printed before the curved surface 911 is formed, the pattern 912 is deformed because the thickness reduces and the surface color becomes lighter. Usually, the above-mentioned pattern 912 can only be printed on a flat decorative surface 910. The one printed on the curved surface 911 can only be a plain one. This put a restriction on the design of the pattern 912 on the inner shell 91.

2. As described above, through thermoplastic molding and vacuum suction the inner shell 91 is cured to form the flat decorative surface 910 and curved surface 911 on the side. Therefore, during the production process, there must involve a molding process, thus a certain cost. Moreover, each decorative surface 910 of the inner shell 91 can only be designed with a single pattern. To have different pattern designs, they must be formed on different inner shells 91. Therefore, in addition to the problem of limited pattern designs, assembling the inner shell 91 printed with the pattern on the decorative surface 910 to the outer shell also has the problem of high costs.

3. When assembling the inner lining 92 to in the outer shell 90, the side edge is first sewn to a glue strip 93. The glue strip 93 is then embedded in the end edge of the outer shell 90. The inner side of the glue strip 93 inside the outer shell 90 is slightly pulled out so that the inner shell 91 is wrapped around by the glue strip 93. However, the glue strip 93 is first sewn to the lining 92 and then installed to the outer shell 90. The glue strip 93 and the inner shell 91 are covered by the lining 92. To fix the inner shell 91 in the glue strip 93, one can merely pull up the glue strip 93 by touching to cover the inner shell 91. This causes problems and troubles for assembly.

SUMMARY OF THE INVENTION

One objective of the invention is to solve the above-mentioned problems by providing a transparent shell structure for luggage and the like. A flat and bendable decorative plate replaces the conventional inner shell and is disposed inside the transparent outer shell. Since the entire decorative plate can have a pattern design, the design pattern can be shown even along the side or bending part of the outer shell. It can avoid the restrictions on pattern designs. In comparison with the inner shell conventionally formed by thermoplastic molding, the disclosed flat decorative plate has a reduced cost.

Another objective of the invention is to directly fix the lining to the decorative plate, which is then disposed inside the outer shell. The decorative plate is restricted by the blocking part inside the outer shell. Since the lining and the decorative plate are combined together, they do not become barriers for shell assembly. This increases the assembly efficiency of the shells.

To achieve the above-mentioned objectives, the disclosed shell structure includes: an outer shell, a decorative plate, a lining, and a plurality of corner protectors.

The outer shell has a rectangular shape and is made of a transparent material. The outer shell has an inner space with an opening on one side thereof. The end edge of the outer shell on the side of the opening is provided with a frame along the rim of the opening.

The decorative plate is made of a plastic material, has a flat shape, and can be bent. One side of the decorative plate is a decorative surface formed with a pattern. Each of the four corners of the decorative plate has a notch. The four sides of the decorative plate are separated by the notches at the four corners. The decorative plate is inserted into the inner space via the opening of the outer shell. The four sides of the decorative plate are attached to the inner surface profile of the inner space of the outer shell and are individually folded, with bare space formed at the notches. The shell has blocking parts corresponding to the folded ends of the decorative plate. The decorative plate is disposed into the inner space of the outer shell and is restricted within the outer shell by the blocking parts.

The lining has an area at least equal to that of the decorative plate. It is stacked to the opposite surface to the decorative surface of the decorative plate, and is integrally fixed to the decorative plate. It is disposed into the inner space of the outer shell along with the decorative plate, connecting to the frame via the sides thereof.

The corner protectors are connected to the four corners of the outer shell to cover the bare space at the four notches.

BRIEF DESCRIPTION OF THE DRAWINGS

These and other features, aspects and advantages of the invention will become apparent by reference to the following description and accompanying drawings which are given by way of illustration only, and thus are not limitative of the invention, and wherein.

DETAILED DESCRIPTION OF THE INVENTION

The present invention will be apparent from the following detailed description, which proceeds with reference to the accompanying drawings, wherein the same references relate to the same elements.

Please refer to FIGS. 1 to 8 for an embodiment of the invention. Note that this embodiment is for illustrative purposes only, and should not be used to restrict the invention.

This embodiment provides a transparent shell structure for luggage and the like. The luggage and the like are mainly composed of two shells combined together. In this embodiment, luggage is used as an example. The shell structure of the luggage includes: an outer shell 1, a decorative plate 2 and a lining 3.

Figure 1:
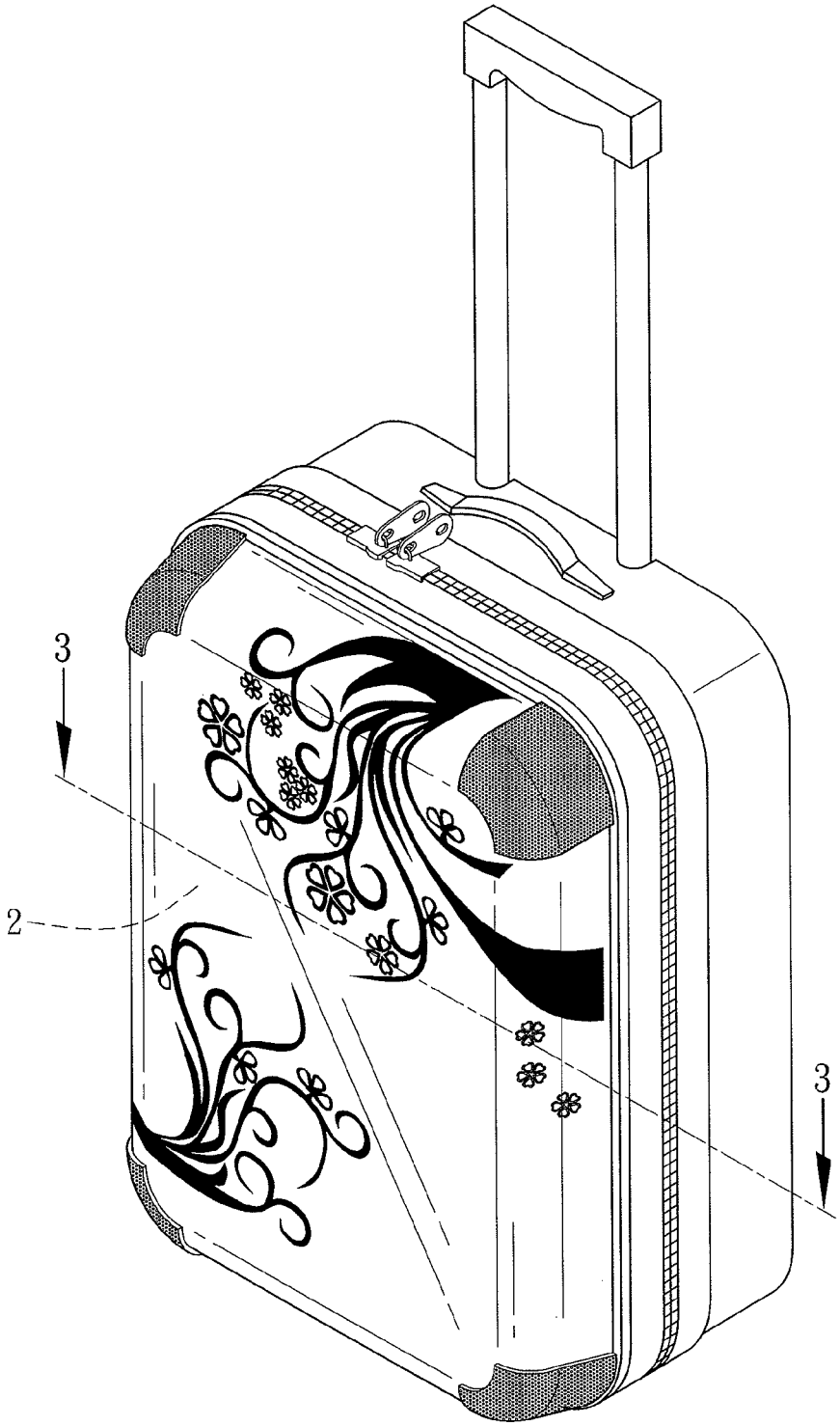
FIG. 1 is a three-dimensional perspective view of the luggage in the first embodiment of the invention.
Figure 2:
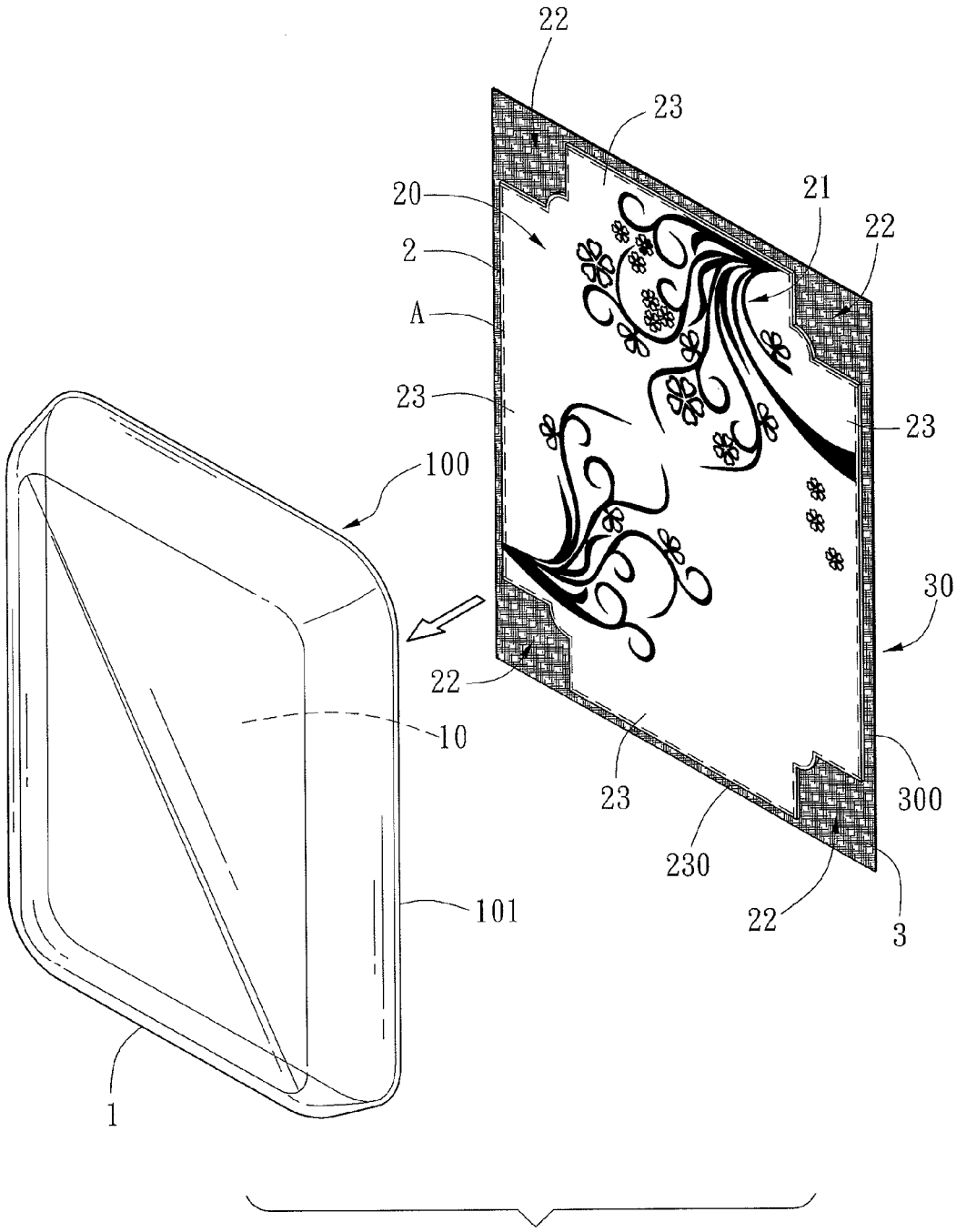
FIG. 2 is a schematic view of the shell structure according to the first embodiment.

As shown in FIGS. 1 and 2, the outer shell 1 has a rectangular shape. The surface at four sides is bent into arcs. The outer shell 1 is made of a transparent material. The outer shell 1 has an inner space 10 with an opening 100 on one surface thereof.

Figure 3:
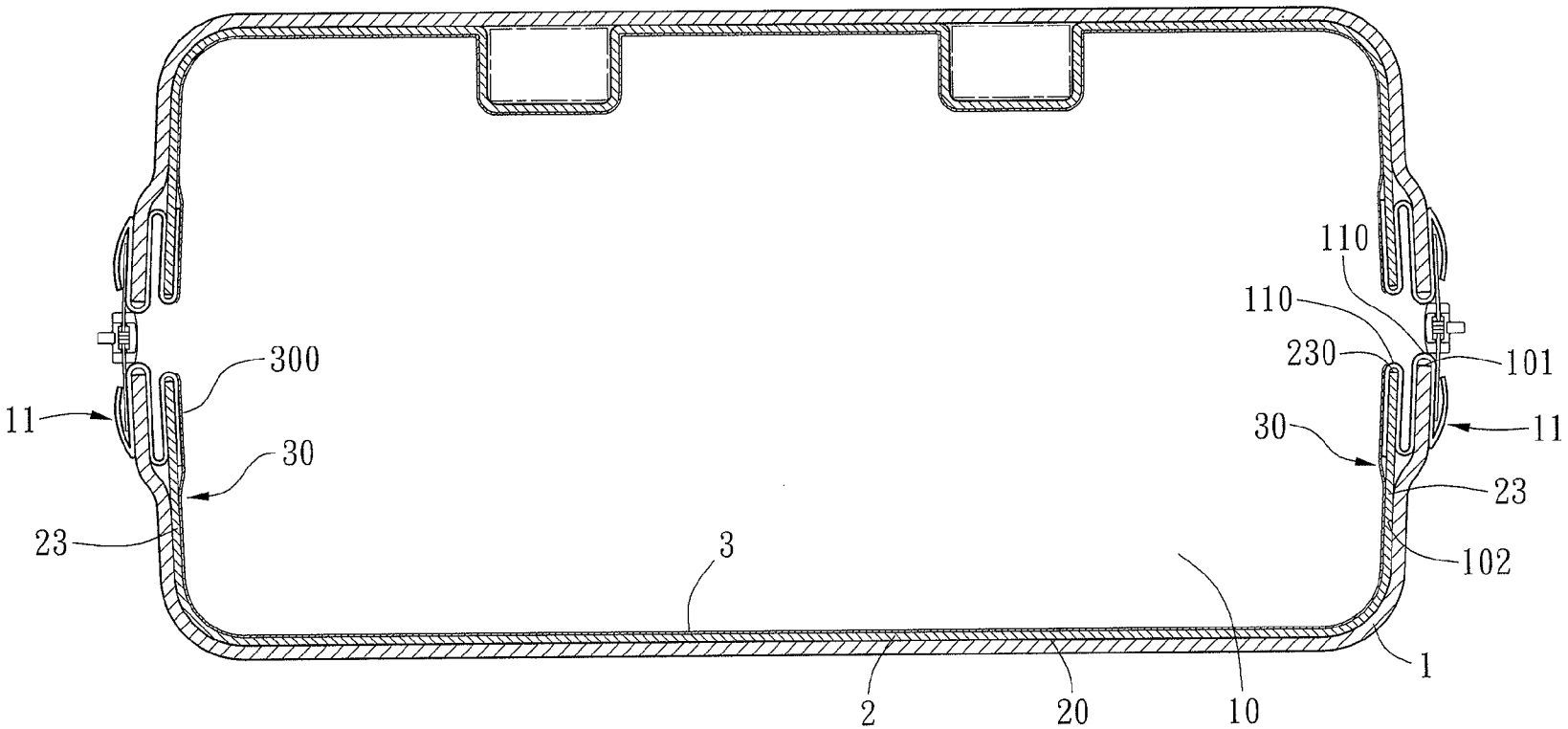
FIG. 3 is a cross-sectional view top view of the luggage in the first embodiment.
Figure 5:
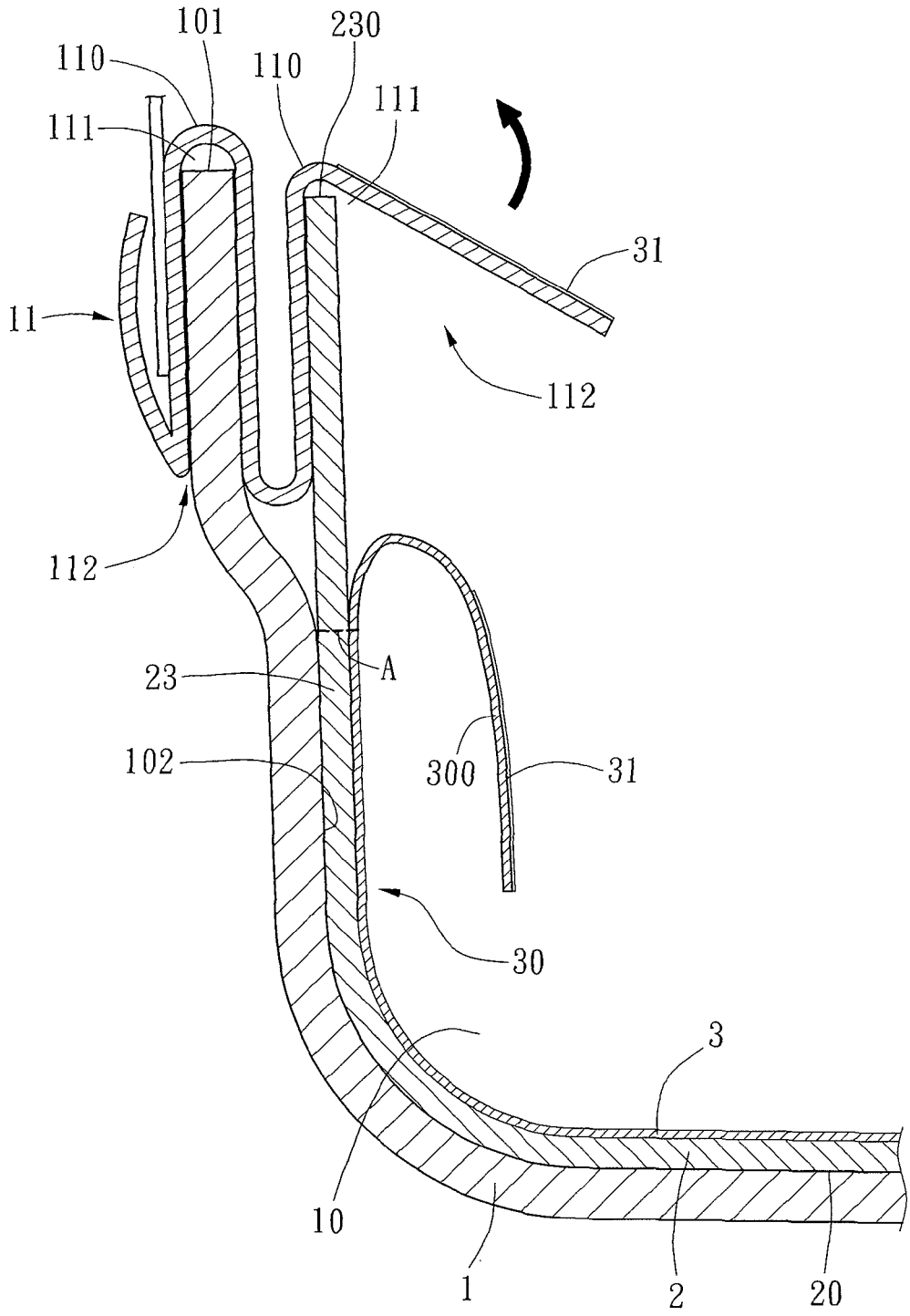
FIG. 5 is a cross-sectional view showing that the socket part of the frame makes the end edge of the decorative plate embedded into the embedding groove according to the first embodiment.

As shown in FIGS. 2 and 3, the outer shell 1 has a frame 11 along the rim of the opening 100 on the end edge 101 of the opening 100. The frame 11 in this embodiment is a glue strip. As shown in FIGS. 3 and 5, the glue strip is folded to form two adjacent socket parts 110. One of the socket parts 110 is on the inner side, and the other socket part 11 is on the outer side. The two socket parts 110 respectively have an embedding groove 111, each of which has an opening 112. The two openings 112 face the same side. The outer shell 1 is embedded in the embedding groove 111 of the outer socket part 110 via the end edge 101 thereof.

Figure 4:
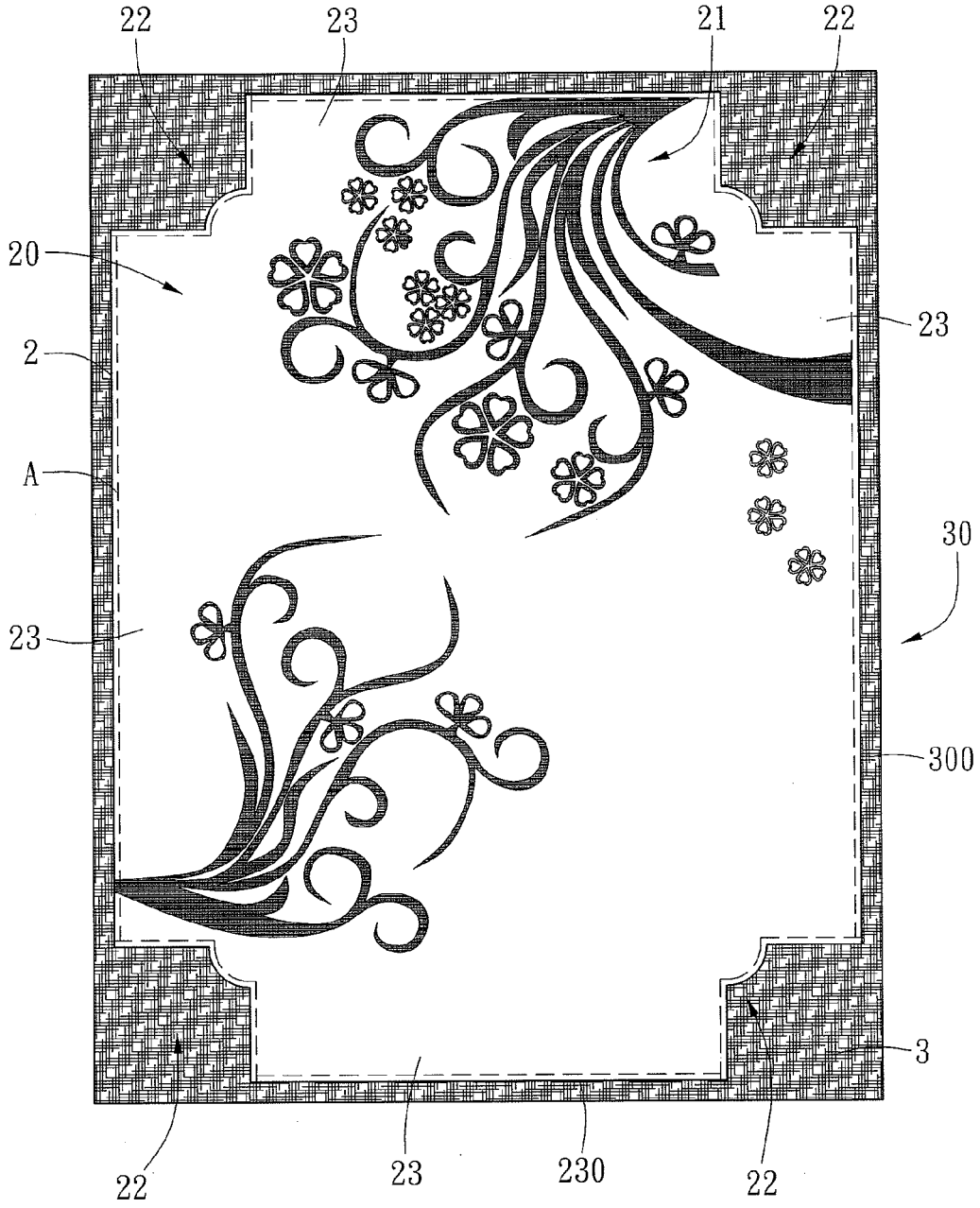
FIG. 4 is a planar view of the decorative plate connected with the lining according to the first embodiment.

As shown in FIGS. 2 and 4, the decorative plate 2 is made of a plastic material. It has a flat shape and can be bent. One side of the decorative plate 2 is a decorative surface 20 with a pattern 21. The decorative plate 2 has a notch 22 at each of the four corners 22 thereof. The four notches 22 in this embodiment are of equal size. The four sides 23 of the decorative plate 2 are separated by the notches 22 on the four corners. The decorative plate 2 is disposed into the inner space 10 via the opening 100 of the outer shell 1. The four edges 23 of the decorative plate 2 are attached to and folded along the inner surface profile 102 of the inner space 10 of the outer shell 1, forming a curved surface at the folded parts. Bare space is formed at each of the notches 22. The outer shell has blocking parts at the end edges 230 folded from the four sides 23 of the decorative plate 2. Each of the blocking part in this embodiment is the inner socket part 110 of the frame 11. As shown in FIG. 5, the decorative plate 2 is embedded in the embedding groove 111 of the inner socket part 110 via the end edge 230 in the inner space 10 of the outer shell 1.

As shown in FIGS. 1, 2 and 4, the pattern in this embodiment can be a decorative pattern (or words). It is directly printed on the decorative surface 20 of the decorative plate 2.

Figure 6:
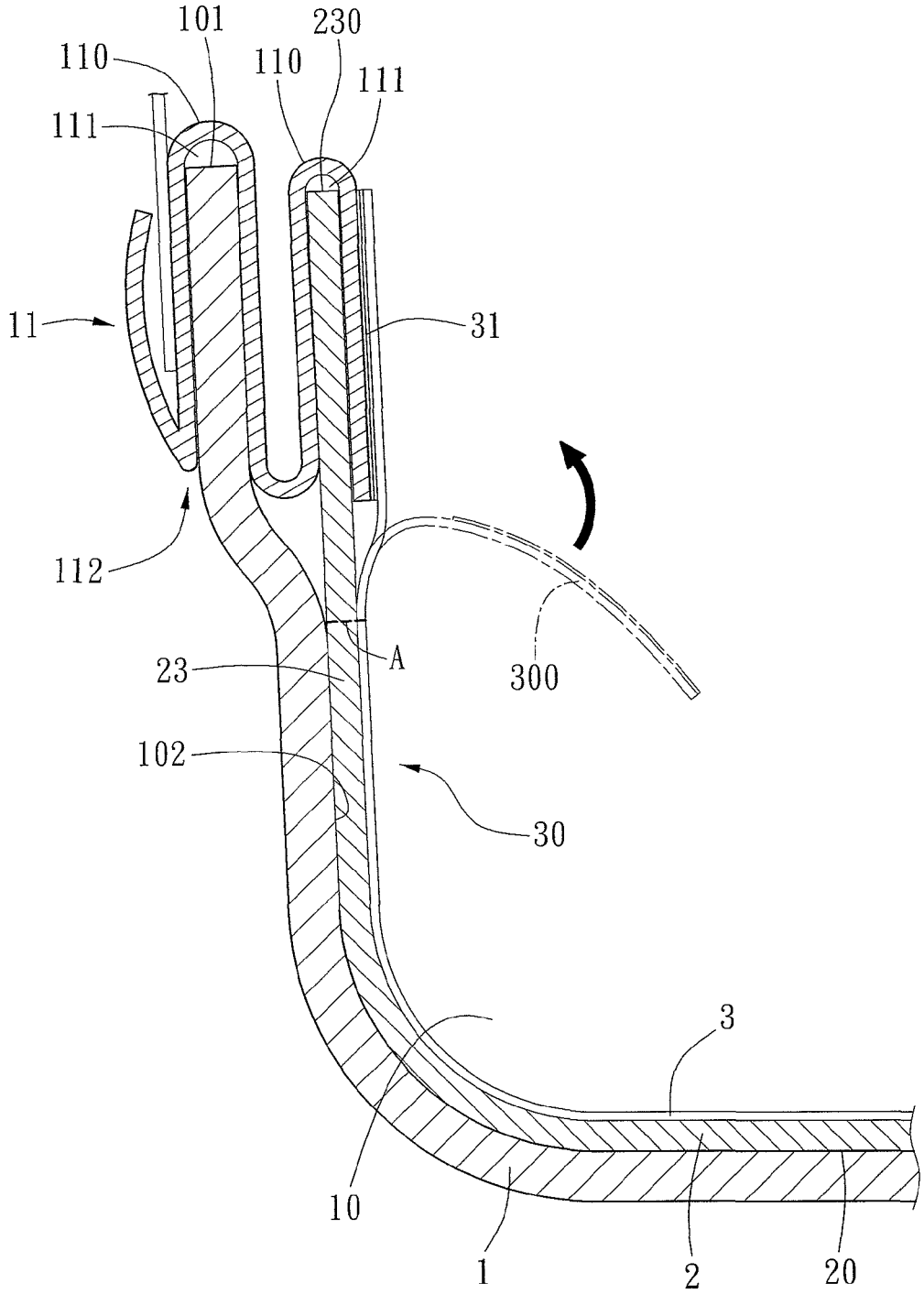
FIG. 6 is a cross-sectional view of the first embodiment in which the connection segment of the lining and the socket part of the frame are fixed with a Velcro tape.
Figure 7:
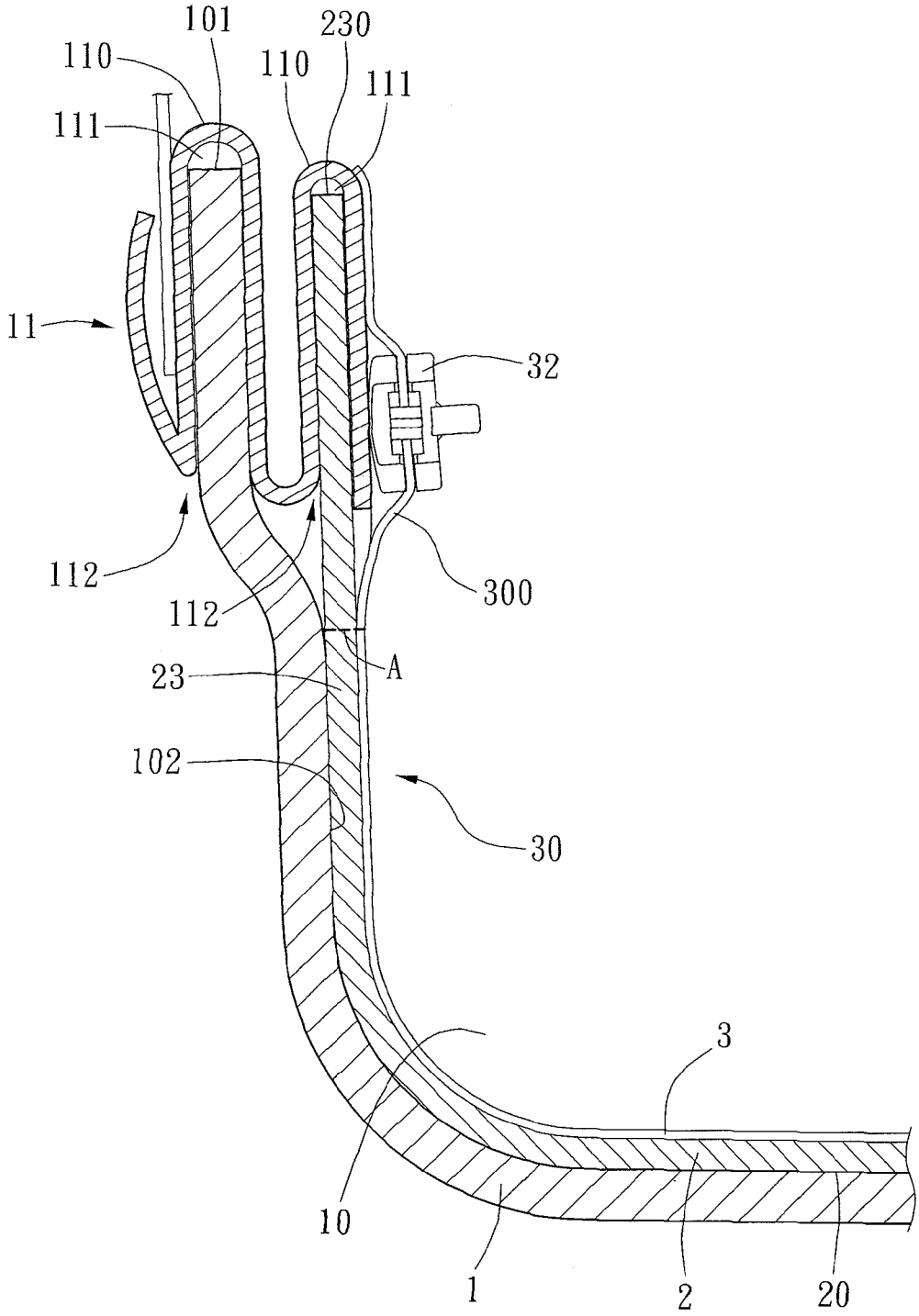
FIG. 7 is a schematic cross-sectional view of the first embodiment in which the connection segment of the lining and the socket part of the frame are connected via a zipper.

As FIGS. 2 and 4 show, the area of the lining 3 in this embodiment is slightly larger than that of the decorative plate 2. Moreover, the lining 3 is stacked on the surface of the decorative plate 2 opposite to the decorative surface 20. In this embodiment, the lining 3 and the four sides 23 of the decorative plate 2 are fixed integrally, and are disposed into the inner space 10 of the outer shell 1 along with the decorative plate 2. The lining 3 is connected to the frame 11 via the sides 30 thereof. As shown in the drawings, the lining 3 in this embodiment is sewn (indicated by line A) to the four sides 23 of the decorative plate 2. As shown in FIG. 4, the sides of the lining 3 are reserved with a connection segment 300 when sewing. The lining 3 uses the connection segment to connect with the frame 11 via a book loop tape 31, as shown in FIG. 6. In addition to sewing on the four sides 23 of the decorative plate 2, the lining is 3 can also be fixed onto the decorative plate 2 by an adhesion means. Moreover, the connection segment 300 of the lining 3 can also be connected with the frame 11 with a zipper 32, as shown in FIG. 7, besides the hook and loop tape 31.

Figure 8:
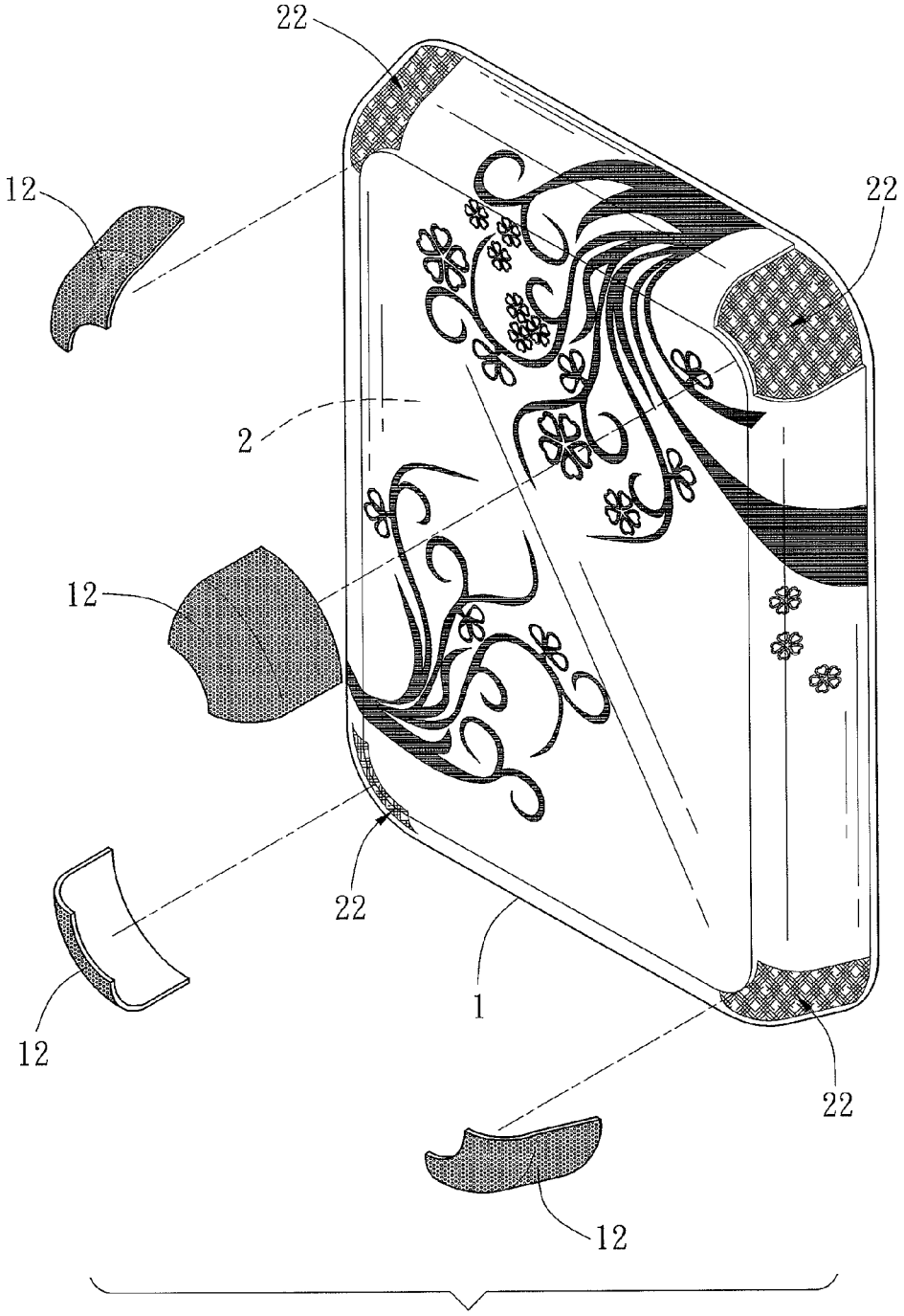
FIG. 8 is a schematic view of the first embodiment shell structure in which corner protectors cover the bare space of the notches of the decorative plate.

As shown in FIG. 8, when the decorative plate 2 is disposed in the inner space of the outer shell 1, the four corners of the outer shell 1 are the bare space due to the four notches 22. Several corner protectors 12 are connected to the four corners of the outer shell 1 to cover the bare space at the four notches 22.

It is easy to see the following advantages of the present invention:

1. The decorative plate 2 of the invention has a flat shape and can be bent. When it is placed inside the outer shell 1, it is naturally bent to form a curved surface corresponding to the inner space 10 of the outer shell 1. The formation of the curved surface is due to the bending of the decorative plate 2, instead of the curved surface 911 formed conventionally by thermoplastic molding from an inner shell 91. Therefore, the pattern 21 on the decorative surface 20 of the decorative plate 2 does not have the problem that the curved surface is extended and stretched to render a thinner thickness and lighter surface color. This does not result in any restriction on the pattern design on the decorative surface 20.

2. The decorative plate 2 of the invention has a flat shape and can be bent. The production is fairly simple. The components are relatively cheap in cost, and can be easily put away. Even if a lot of decorative plates 2 are required for different pattern designs, the costs for the components of the decorative plate 2 will still not become the burden of the overall cost. Since the assembly of the decorative plate 2 and the outer shell 1 is quick and easy, this kind of decorative plates 2 can also be designed so that users replace them from time to time, achieving diversity in the decorative surfaces.

3. The lining 3 of the invention is fixed to the decorative plate 2, and is disposed into the inner space 10 of the outer shell 1 along with the decorative plate 2 during the assembly.

It is restricted inside the outer shell 1 by the blocking parts (such as the frame 11 in this embodiment). Thus, the lining 3 does not have the problem of a conventional lining 92 that covers glue strips 93 and the inner shell 91. The decorative plate 2 can be easily embedded into the embedding grooves 111 of the socket parts 110 via the end edges 230 thereof by visual inspection. This can avoid the problem that the lining 3 hinders the assembly of the shells, thereby increasing the assembly efficiency.

Figure 9:
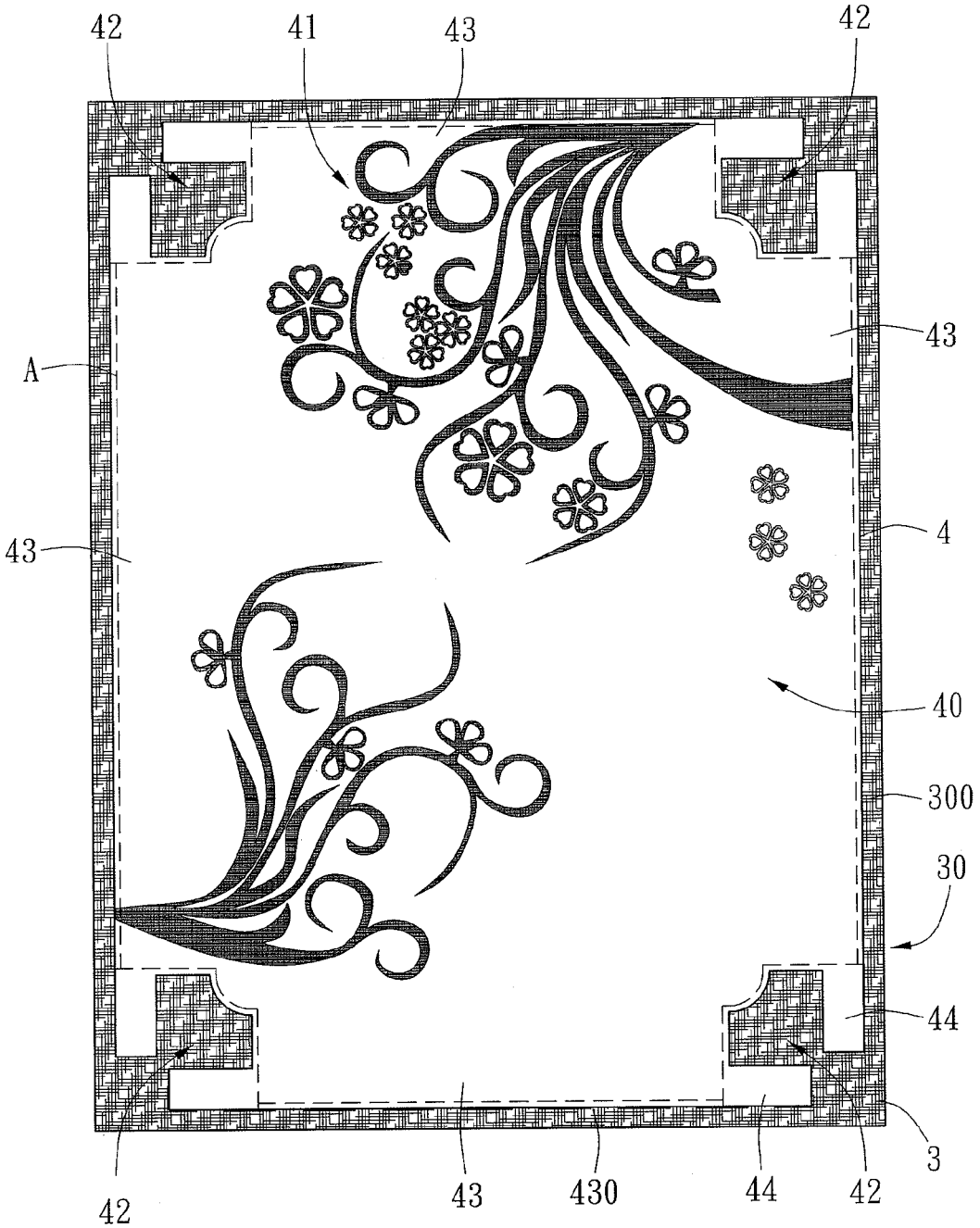
FIG. 9 is a planar view of the decorative plate connected with the lining according to the second embodiment.
Figure 10:
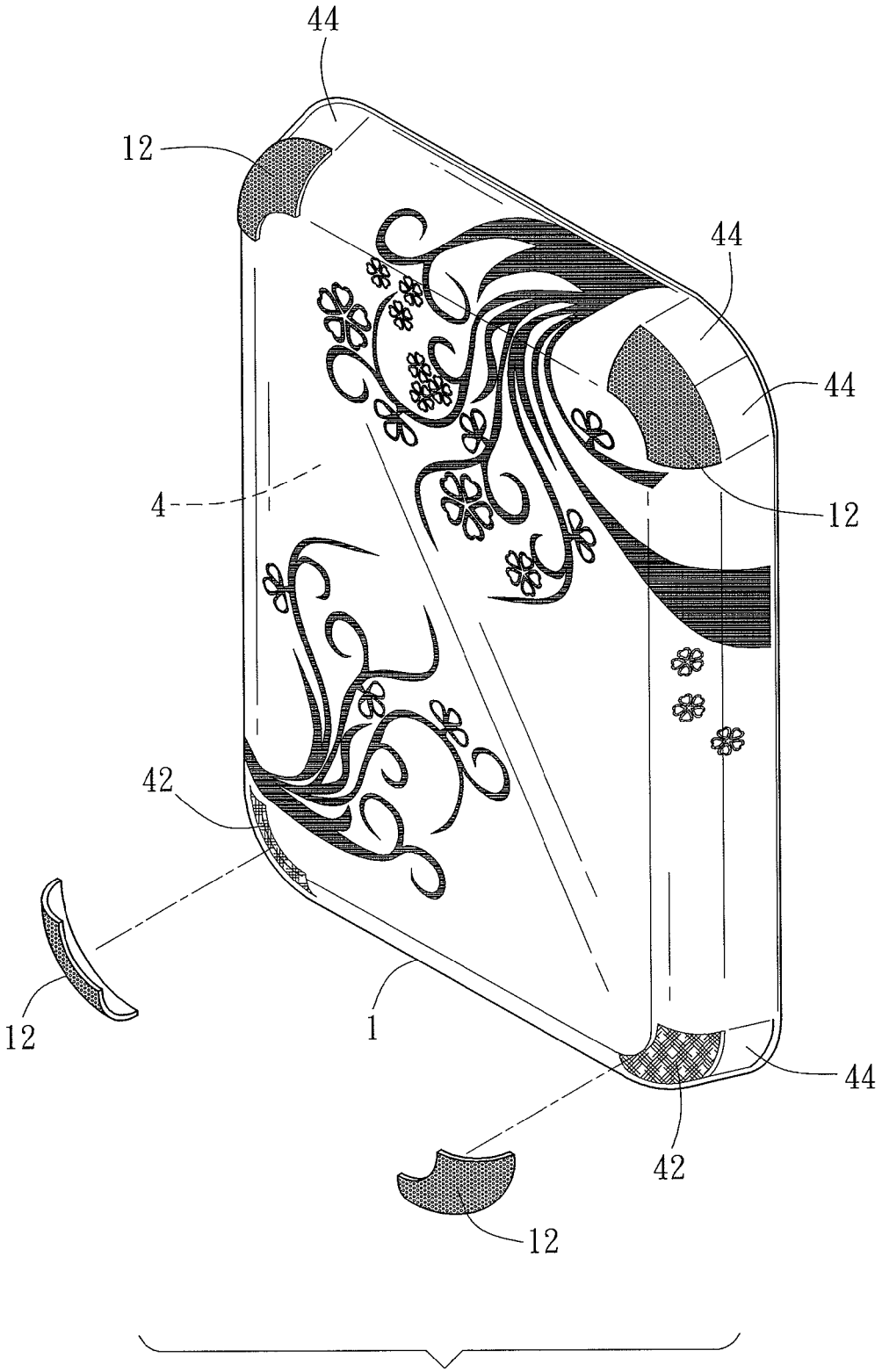
FIG. 10 is a schematic view of the second embodiment shell structure in which corner protectors cover the bare space of the notches of the decorative plate.
Figure 11:
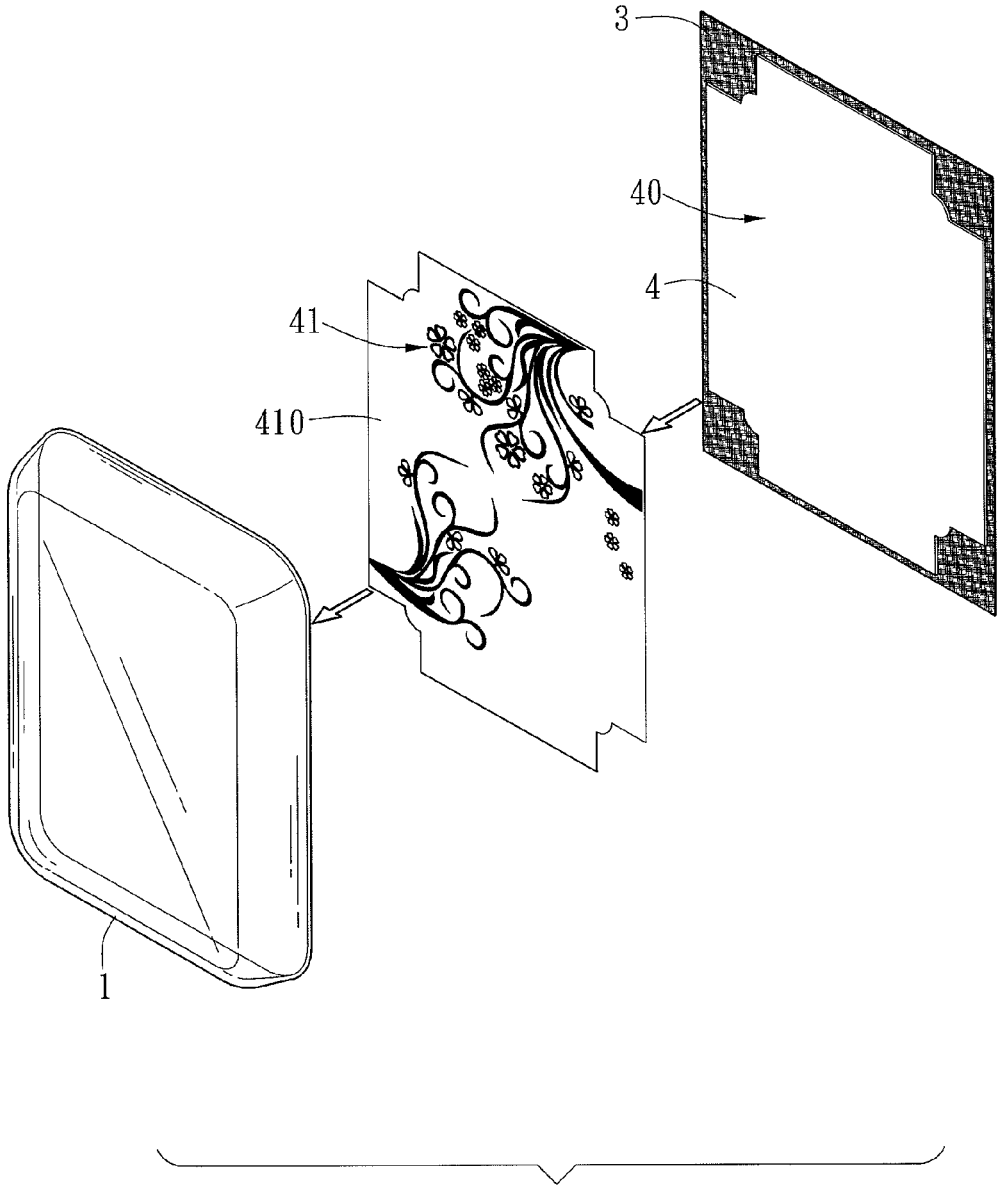
FIG. 11 shows the configuration of the outer shell, the decorative plate, the patterned printing paper, and the lining according to the second embodiment of the invention.

Of course, the invention has many other embodiments, with only variations in the details. Please refer to FIGS. 9 to 11 for the second embodiment of the invention. The decorative plate 4 in this embodiment has a decorative surface 40 and a pattern 41 as in the first embodiment. Both sides of each of the notches 42 are extended with a connecting part 44 toward the corresponding notch 42. When the four sides 43 of the decorative plate 4 are folded, the two connecting parts 44 at the same notch 42 are connected as shown in FIG. 10 and form an arc angle along the two adjacent edges 43 at the notch 42. Furthermore, as shown in FIG. 11, on the decorative plate 4 in this embodiment, the pattern 41 is printed on a printing paper 410. The printing paper 410 has the same size as the decorative plate 4 and is attached onto the decorative surface 40 of the decorative plate 4. In this way, this embodiment achieves the same effects as the first embodiment.

Figure 12:
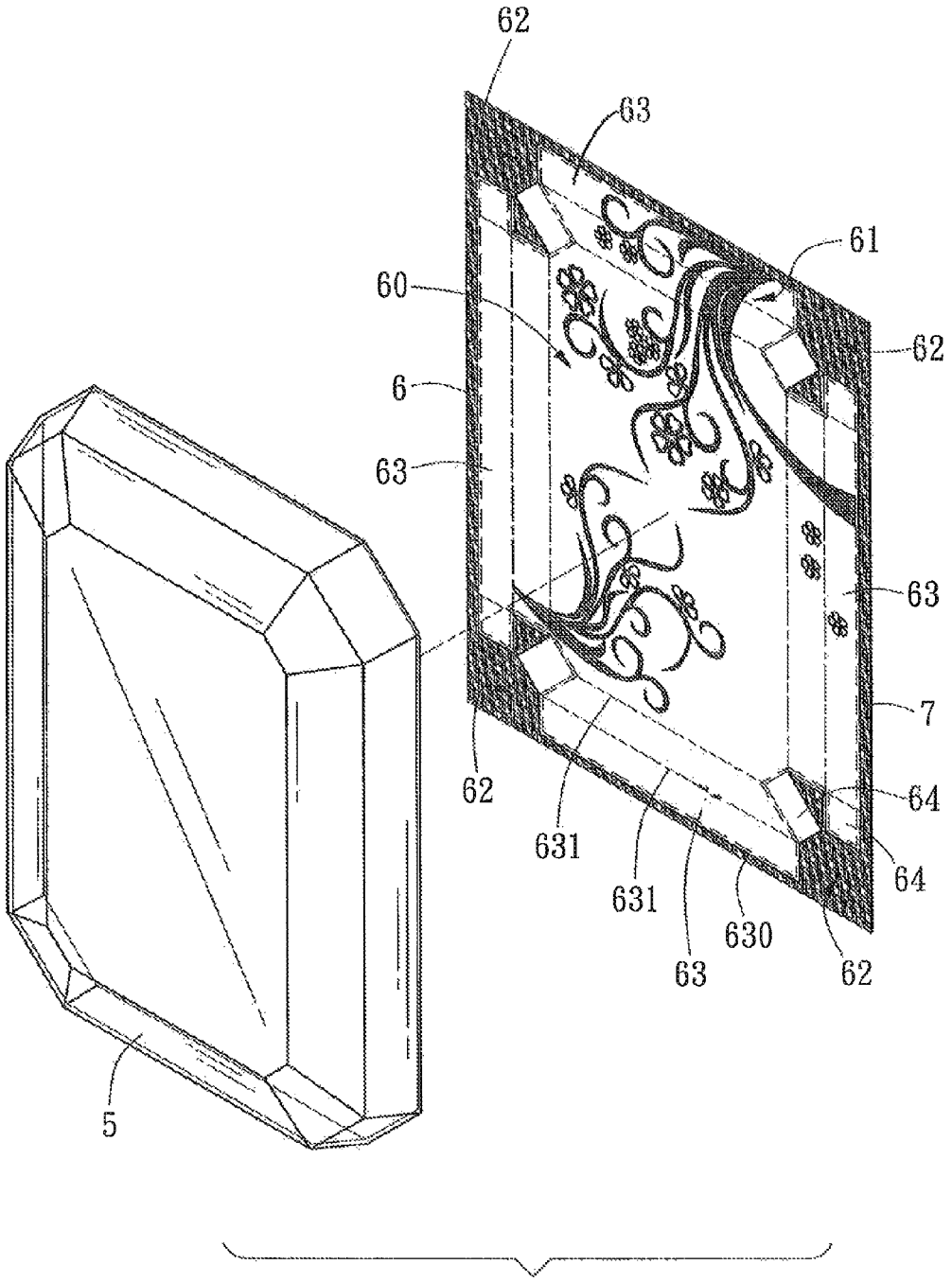
FIG. 12 is an assembly view of the shell structure according to the third embodiment of the invention.
Figure 13:
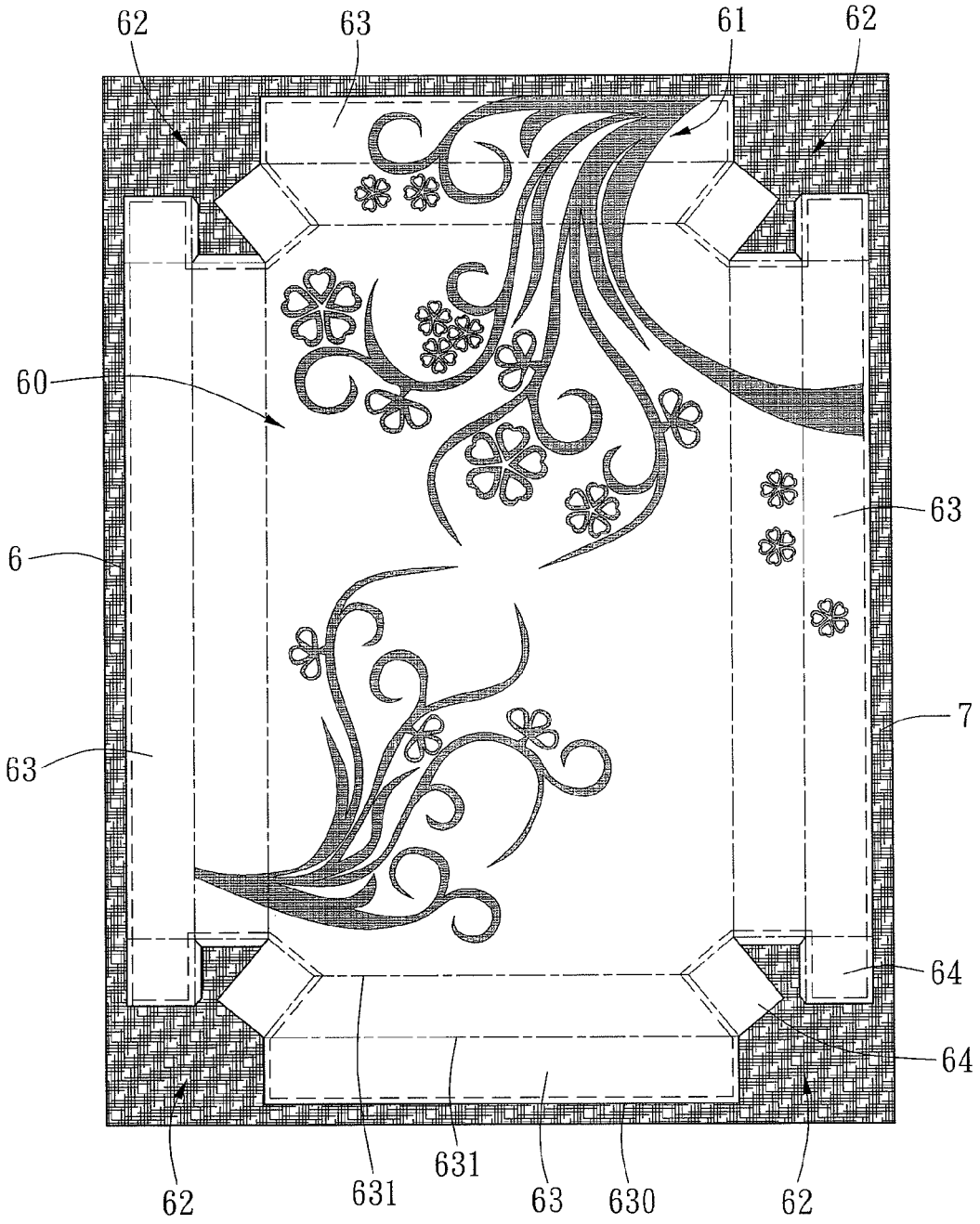
FIG. 13 is a planar view of the decorative plate connected with the lining according to the third embodiment of the invention.
Figure 14:
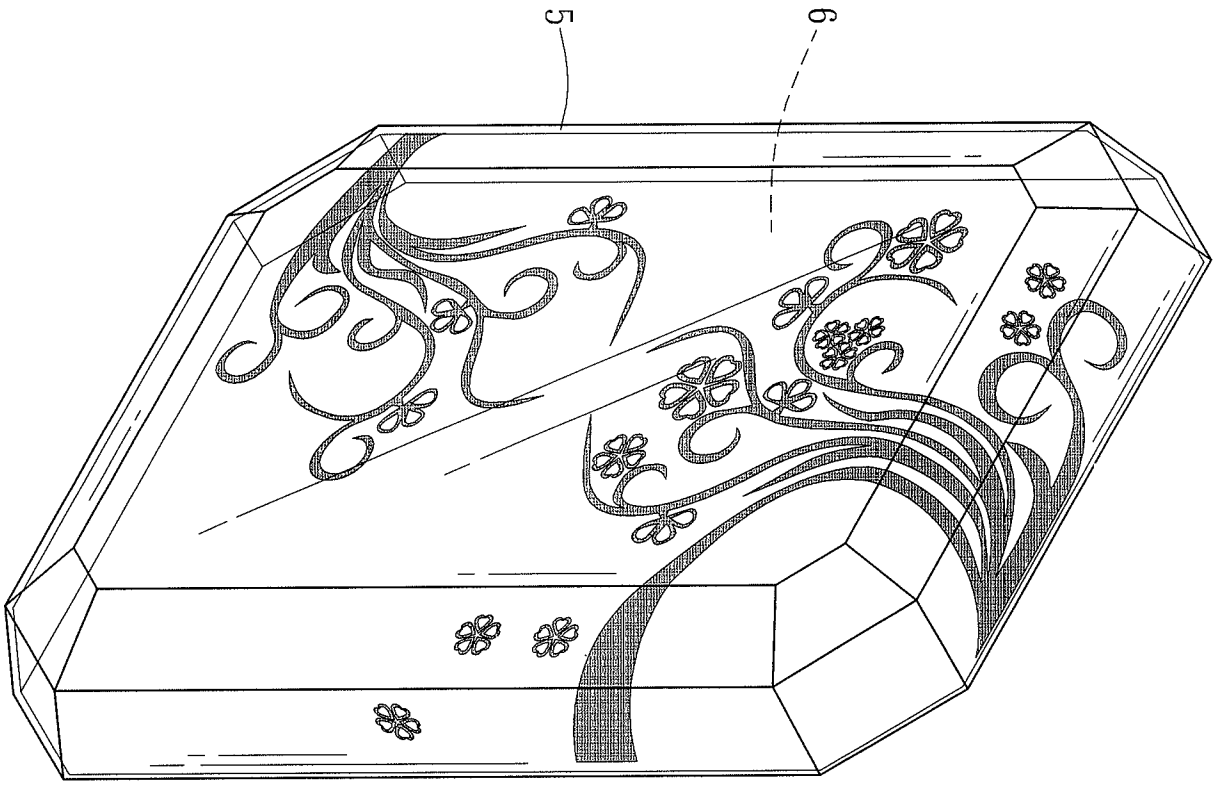
FIG. 14 is a schematic view of disposing the decorative plate inside the frame according to the third embodiment.
Figure 15:
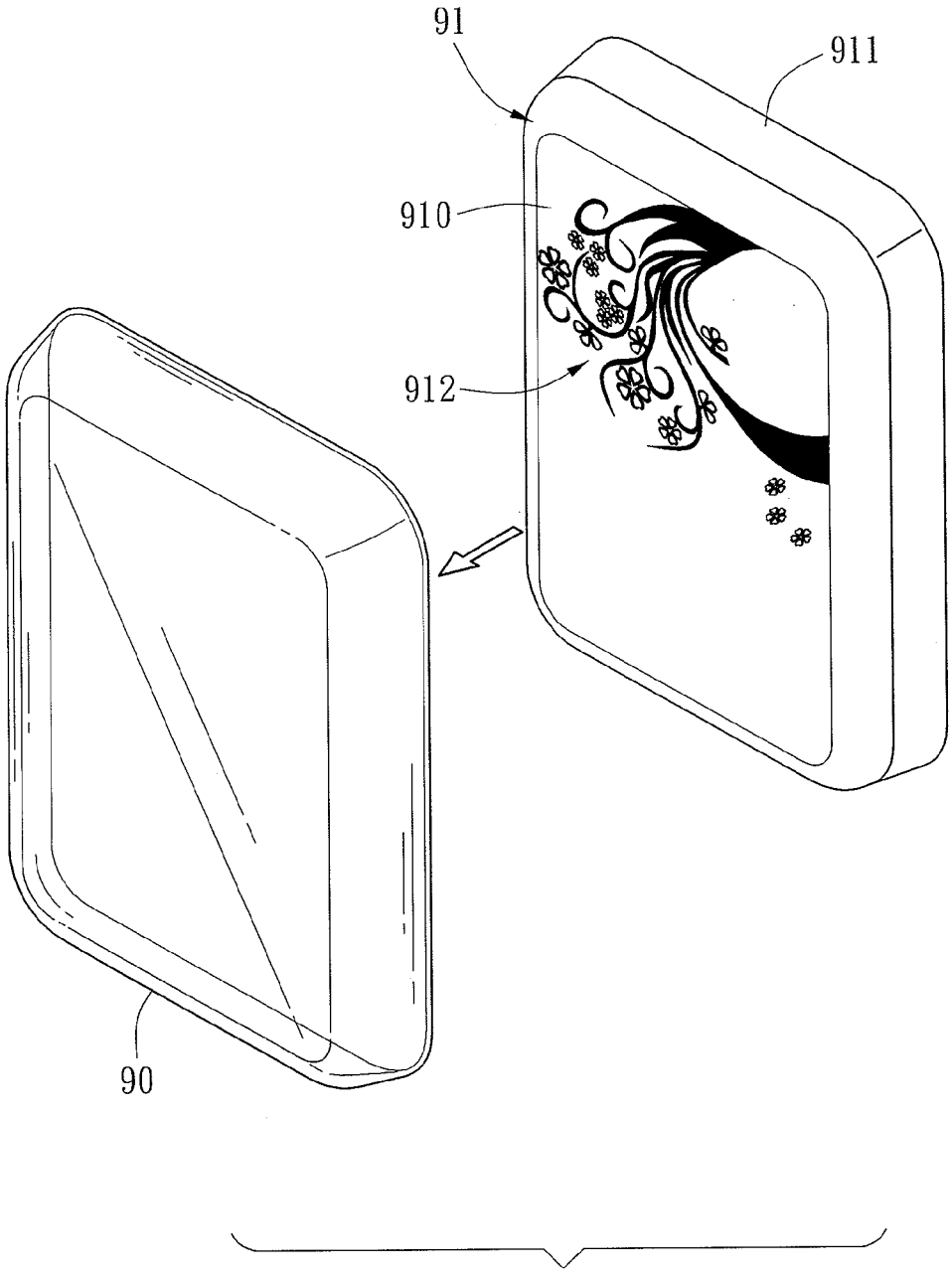
FIG. 15 PRIOR ART
FIG. 15 shows the configuration a conventional shell structure.
Figure 16:
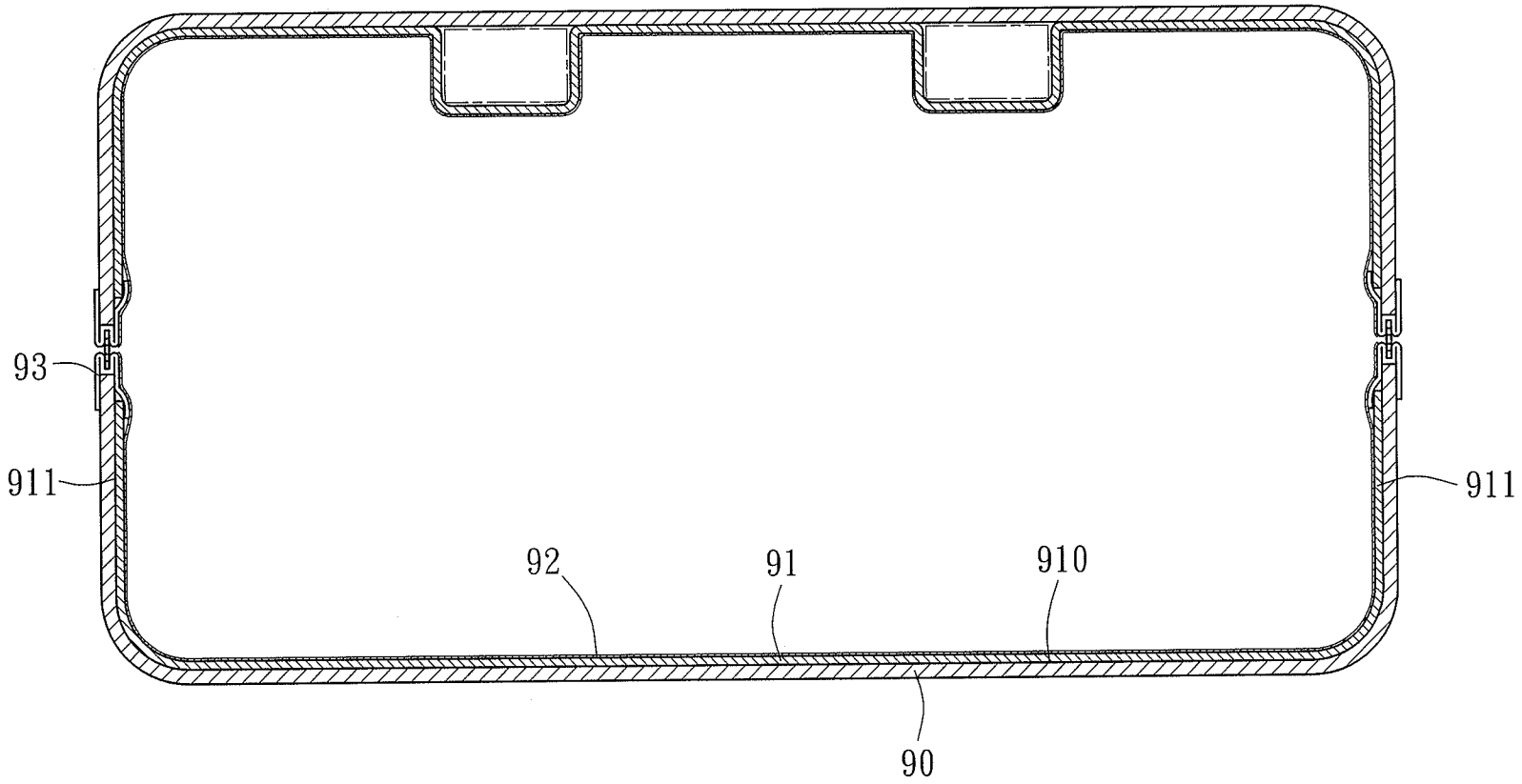
FIG. 16 PRIOR ART
FIG. 16 is a top view of a conventional luggage.

Please refer to FIGS. 12 to 14 for the third embodiment of the invention. The surface of the outer frame 5 has several sharp-angled turns on the four sides, instead of the arc-shaped bending in the first embodiment. The decorative plate 6 has a decorative surface 60 and a pattern 61, as in the first embodiment. Both sides of each of the notches 62 are extended with a connecting part 64 near the end edge 630 of the side 63 and toward the corresponding notch 62. The decorative plate 6 in this embodiment has a pre-fold line 631 on each side 63. The four sides 63 of the decorative plate are folded along the pre-fold lines 631 inside the outer frame 5. The connecting parts 64 at the same notch 62 are connected in the outer frame 5. As shown in FIG. 14, the connected connecting parts 64 completely cover the lining 7 in this embodiment. The decorative plate 6 correspondingly forms folding angles on the four sides 63 thereof and at the joint position of the connecting parts 64 in the outer frame 5.

Although the invention has been described with reference to specific embodiments, this description is not meant to be construed in a limiting sense. Various modifications of the disclosed embodiments, as well as alternative embodiments, will be apparent to people skilled in the art. Therefore, it is contemplated that the appended claims will cover all modifications that fall within the true scope of the invention.

What is claimed is:

1. A transparent shell structure for luggage and the like comprises two shells connected together, at least one of the shells includes:

an outer shell with a rectangular shape and made of a transparent material, the outer shell having an inner space with an opening on one surface of the outer shell, and the end edge of the outer shell on the side of the opening being provided with a frame along the rim of the opening;

a decorative plate, having four sides and four corners, made of a plastic material and being flat and bendable, one surface of the decorative plate being a decorative surface with a pattern, each of the four corners of the decorative plate having a notch to separate the four sides thereof, wherein the decorative plate is disposed into the inner space via the opening of the outer shell, the four sides of the decorative plate are individually bent along the inner surface of the inner space of the outer shell, the end edges of the four folded sides are correspondingly provided with blocking parts, and the decorative plate is restricted by the blocking parts inside the outer shell after being disposed inside the inner space; and a lining with an area at least equal to that of the decorative plate and stacked to the surface of the decorative plate opposite to the decorative surface, the lining being integrally fixed to the decorative plate and disposed into the inner space with the decorative plate and connected to the frame via the sides thereof;

wherein the side of the lining is reserved with a connection segment when sewing, and the lining uses the connection segment to connect with the frame via a hook and loop tape or zipper;

wherein the frame is bent to form two adjacent socket parts, each of which has an embedding groove, each of the two embedding grooves has an opening facing the same side, the embedding groove of one of the socket parts is for the end edge of the outer shell to engage, the embedding groove of the other socket part is for the end edge of the decorative plate to engage.

2. The transparent shell structure for luggage and the like of claim 1, wherein the frame is a glue strip.

3. The transparent shell structure for luggage and the like of claim 1, wherein the pattern is directly printed on the decorative surface of the decorative plate.

4. The transparent shell structure for luggage and the like of claim 1, wherein the pattern is directly printed on printing paper with the same area as that of the decorative plate to be fixed on the decorative surface of the decorative plate.

5. The transparent shell structure for luggage and the like of claim 1, wherein the four sides of the decorative plate are individually bent along the inner surface profile of the inner space of the outer shell, the notches form bare space to expose the lining, and a plurality of corner protectors are connected to the four corners of the outer shell to cover the bare space at the four corners.

6. The transparent shell structure for luggage and the like of claim 5, wherein both sides of the notch are extended with a connecting part respectively toward the notch, the two connecting parts at the same notch connect when the four sides of the decorative plate are individually folded, and each two joined connecting parts form an arc angle at the corresponding notch.

7. The transparent shell structure for luggage and the like of claim 1, wherein both sides of the notch are extended with a connecting part respectively toward the notch, the two connecting parts at the same notch connect to completely cover the lining when the four sides of the decorative plate are individually folded, and the decorative plate form several folding angles on the four sides and at the joints of the connecting parts.

8. The transparent shell structure for luggage and the like of claim 1, wherein the lining is sewn or adhered to the four sides of the decorative plate.

* * * * *